US010002704B2

(12) United States Patent
Kumura et al.

(10) Patent No.: US 10,002,704 B2
(45) Date of Patent: Jun. 19, 2018

(54) COIL MODULE

(71) Applicant: DEXERIALS CORPORATION, Tokyo (JP)

(72) Inventors: Tatsuo Kumura, Tochigi (JP); Yusuke Kubo, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 288 days.

(21) Appl. No.: 14/649,388

(22) PCT Filed: Nov. 27, 2013

(86) PCT No.: PCT/JP2013/081836

§ 371 (c)(1),
(2) Date: Jun. 3, 2015

(87) PCT Pub. No.: WO2014/087888

PCT Pub. Date: Jun. 12, 2014

(65) Prior Publication Data

US 2015/0325362 A1 Nov. 12, 2015

(30) Foreign Application Priority Data

Dec. 4, 2012 (JP) ..... 2012-265135

(51) Int. Cl.
*H01F 5/00* (2006.01)
*H01F 27/28* (2006.01)
(Continued)

(52) U.S. Cl.
CPC ..... *H01F 27/2885* (2013.01); *H01F 5/00* (2013.01); *H01F 27/255* (2013.01);
(Continued)

(58) Field of Classification Search
CPC ..... H01F 5/00; H01F 27/00–27/36
(Continued)

(56) References Cited

U.S. PATENT DOCUMENTS 7,495,538 B2 * 2/2009 Tsunemi ..... H01F 3/10 336/84 M
2005/0083203 A1 * 4/2005 Surkau ..... G06K 19/07771 340/572.7

FOREIGN PATENT DOCUMENTS

JP 2006-174223 A 6/2006
JP 2007-116347 A 5/2007
(Continued)

OTHER PUBLICATIONS

Feb. 25, 2014 International Search Report issued in International Patent Application No. PCT/2013/081836.

*Primary Examiner* — Tuyen Nguyen
(74) *Attorney, Agent, or Firm* — Oliff PLC

(57) ABSTRACT

A coil module is provided which has been reduced in size and thickness by incorporating a material and a structure resistant to magnetic saturation. The coil module includes a magnetic shielding layer containing a magnetic material, and a spiral coil. The magnetic shielding layer has a plurality of magnetic resin layers containing magnetic particles, and at least a portion of the spiral coil is buried in a portion of the magnetic resin layers. This allows a reduction in size and thickness while achieving a heat dissipation effect by the magnetic resin layers. In addition, since magnetic resin layers resistant to magnetic saturation are provided, the coil inductance changes only slightly even in an environment where a strong magnetic field is applied, and thus stable communication can be provided.

11 Claims, 7 Drawing Sheets

(51) Int. Cl.

| | |
|---|---|
| ***H01F 27/29*** | (2006.01) |
| ***H01F 27/255*** | (2006.01) |
| ***H01F 38/14*** | (2006.01) |
| ***H01Q 1/40*** | (2006.01) |
| ***H01Q 7/06*** | (2006.01) |
| ***H01F 27/36*** | (2006.01) |
| *H01F 17/04* | (2006.01) |

(52) U.S. Cl.
CPC ..... *H01F 27/2804* (2013.01); *H01F 27/2871* (2013.01); *H01F 27/29* (2013.01); *H01F 27/365* (2013.01); *H01F 38/14* (2013.01); *H01Q 1/40* (2013.01); *H01Q 7/06* (2013.01); *H01F 2017/048* (2013.01)

(58) Field of Classification Search
USPC ..... 336/65, 83, 96, 200, 206–208, 232–234
See application file for complete search history.

(56) References Cited

FOREIGN PATENT DOCUMENTS

| | | | | |
|---|---|---|---|---|
| JP | 2008-210861 | A | | 9/2008 |
| JP | 2010040701 | A | * | 2/2010 |

* cited by examiner

COIL MODULE

TECHNICAL FIELD

The present invention relates to a coil module that includes a spiral coil and a magnetic shielding layer formed of a magnetic shielding material, and more particularly, to a coil module that has a magnetic resin layer containing magnetic particles, as a magnetic shielding layer. This application claims the benefit of priority from Japanese Patent Application No. 2012-265135, filed on Dec. 4, 2012 in Japan, which is incorporated herein by reference.

BACKGROUND ART

Modern wireless communication devices typically incorporate a plurality of RF antennas, such as a telephone communication antenna, a GPS antenna, a wireless LAN/Bluetooth (registered trademark) antenna, and a radio frequency identification (RFID). In addition to these antennas, it is becoming increasingly common that an antenna coil for electrical power transmission is also incorporated with the advent of non-contact charging technology. Methods of electrical power transmission used in non-contact charging technology include an electromagnetic induction method, a radio reception method, a magnetic resonance method, and the like. These methods all utilize electromagnetic induction or magnetic resonance between a primary coil and a secondary coil, and the RFID described above also utilizes electromagnetic induction.

These antennas are each designed to achieve by itself the best characteristics at an intended frequency. However, once these antennas are incorporated in an electronic device in practice, intended characteristics can hardly be provided. This is because a magnetic field component near the antenna interferes (connects) with that of metal or other object existing nearby, and thus the inductance of the antenna coil essentially decreases. This shifts the resonance frequency. In addition, the essential decrease in the inductance also reduces receiving sensitivity. To solve these problems, a magnetic shielding member is inserted between the antenna coil and the metal existing nearby to allow the magnetic flux generated from the antenna coil to converge on the magnetic shielding member. This can reduce interference caused by metal.

PRIOR ART DOCUMENT

Patent Document

Patent Document 1: Unexamined Japanese Patent Publication No. 2008-210861

SUMMARY OF THE INVENTION

Problems to be Solved by the Invention

Besides the general problems of antenna described above, electromagnetic induction type of non-contact charging requires improvement in transmission efficiency of power transmitted from the primary side to the secondary side while reducing heat generation of the antenna coil. In addition, considering incorporation in an electronic device such as a mobile terminal device, what is most important is achieving reduction in size and thickness of the antenna coil. For example, Patent Document 1 describes a coil module 50 configured such that a magnetic shielding sheet (described herein as a magnetic sheet 4*c*) for converging the magnetic flux is attached to a loop antenna element 2 having a spiral coil form, interposing therebetween an adhesive-applied adhesive layer 41 as shown in FIGS. 7A and 7B. Patent Document 1 also discusses a technology in which a notch 21 is provided in a magnetic sheet 4*b* formed in a sheet form of ferrite or other material, and a lead-out portion 3*a* of a conductor wire 1 of the coil is received in the notch 21 for reducing the thickness of a coil module for use in a non-contact charging application of an electromagnetic induction type.

However, a conventional coil module having a spiral coil used as an antenna coil, and a magnetic sheet provided adjacent thereto can further reduce the size and the thickness of the coil module only by reducing the diameter of the coil winding, and/or by reducing the thickness of the magnetic shielding member. A reduction of the diameter of the coil winding increases the resistance value of the conductor wire (Cu is mainly used), thereby increases the coil temperature. Heat generation by the coil results in an increase in the temperature inside the enclosure of the electronic device, and space for cooling is thus required. This prevents reduction in size and thickness. Moreover, a reduction in size and/or thickness of the magnetic sheet reduces magnetic shielding effect. This causes eddy current to occur in metal (e.g., an outer case of battery pack, and the like) near the antenna coil, and also the coil inductance to decrease, thereby posing a problem in that the transmission efficiency decreases. Furthermore, the magnetic sheet will be magnetically saturated in an environment where a strong magnetic field is applied, which presents a problem in that both the magnetic shielding characteristics and the coil inductance significantly decrease.

A conventional coil module uses adhesive for securing the spiral coil onto the magnetic sheet in the manufacturing process. This poses problems in that the manufacturing process becomes complex, and in addition, that the thickness of the coil module is increased by the thickness of the adhesive-applied layer.

Moreover, a conventional coil module often uses brittle ferrite for the magnetic sheet. In such case, a protection sheet made of electrically insulating material may be attached on both surfaces of the magnetic sheet for preventing damage caused by an external force. This provides problems in that a process for attaching the protection sheets is required, and that the thickness of the coil module is further increased by the thickness of the protection sheets.

Thus, it is an object of the present invention to provide a coil module that has been reduced in size and thickness by incorporating a material and a structure resistant to magnetic saturation.

Means to Solve the Problem

As means to solve the problems described above, a coil module according to the present invention includes a magnetic shielding layer containing a magnetic material, and a spiral coil. The magnetic shielding layer is a stack of a plurality of magnetic resin layers each containing magnetic particles. At least a portion of the spiral coil is buried in the magnetic resin layers. Alternatively, the magnetic shielding layer is a stack of a plurality of magnetic resin layers containing magnetic particles and a magnetic layer.

Advantageous Effects of the Invention

Since a coil module according to the present invention includes magnetic resin layers in which at least a portion of the magnetic shielding layer is buried, a reduction in size and thickness can be achieved while a heat dissipation effect is provided by the magnetic resin layers. In addition, since magnetic resin layers resistant to magnetic saturation are provided, the coil inductance changes only slightly even in an environment where a strong magnetic field is applied, and thus stable communication can be provided.

DESCRIPTION OF THE EMBODIMENTS

Embodiments for implementing the present invention will be described below in detail with reference to the drawings. Note that it will, of course, be appreciated that the present invention is not limited to the embodiments described below, but can be practiced with various modifications without departing from the spirit of the present invention.

First Embodiment

Configuration of Coil Module

Figure 1A:
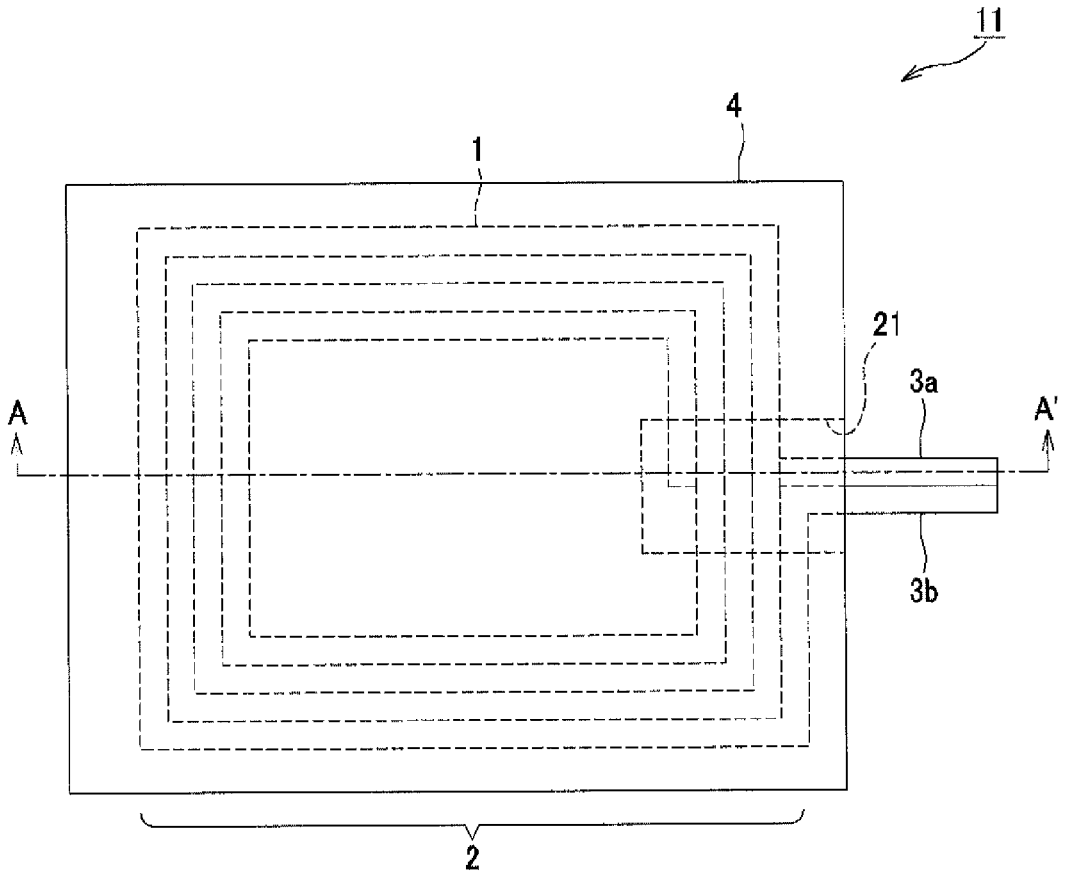
FIG. 1A is a top view of a coil module according to a first embodiment, in which the present invention is implemented.
Figure 1B:
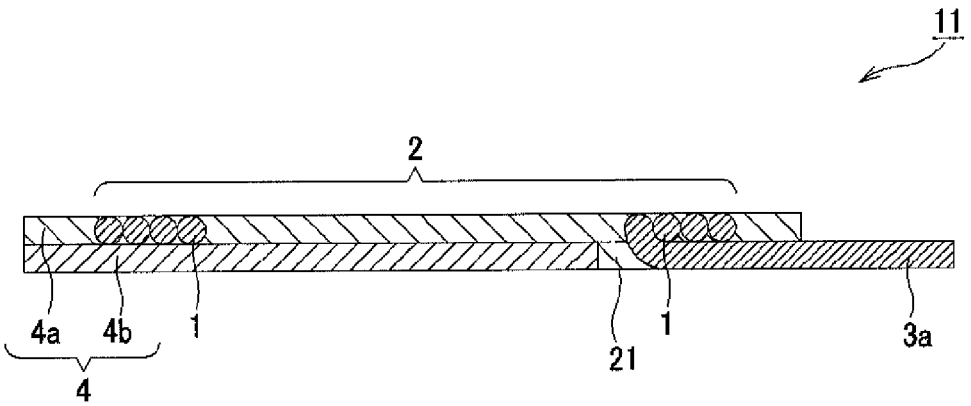
FIG. 1B is a cross-sectional view taken along line A-A' of FIG. 1A.

As shown in FIGS. 1A and 1B, a coil module 11 according to a first embodiment includes a spiral coil 2, formed by winding a conductor wire 1 in a spiral pattern, and a magnetic shielding layer 4 containing a magnetic material. The spiral coil 2 has lead-out portions 3*a* and 3*b* at the ends of the conductor wire 1. By connecting a rectifier circuit or the like to the lead-out portions 3*a* and 3*b*, a secondary circuit of a non-contact charging circuit is formed. As shown in FIG. 1B, the lead-out portion 3*a* on the radially inner side of the spiral coil 2 passes under the conductor wire 1 being wound, and is drawn out to the radially outer side of the spiral coil 2 across the conductor wire 1. The magnetic shielding layer 4 has magnetic resin layers 4*a* and 4*b*, each made of resin containing magnetic particles. The magnetic resin layer 4*b* is provided with a notch 21 formed of the magnetic particle-containing resin of the magnetic resin layer 4*a*, and the notch 21 receives therein the lead-out portion 3*a* on the radially inner side of the conductor wire 1 of the coil. Thus, the magnetic resin layers 4*a* and 4*b* are preferably formed such that the entirety of the spiral coil 2 is buried therein. Since the total thickness of the magnetic resin layers 4*a* and 4*b* can be twice or less the diameter of the conductor wire 1, the thickness of the coil module 11 can be twice the diameter of the conductor wire 1.

Each of the magnetic resin layers 4*a* and 4*b* contains magnetic particles of soft magnetic powder, and a resin as a bonding agent. The magnetic particles are made of an oxide magnetic material, such as ferrite; a crystalline or microcrystalline metallic magnetic material, such as Fe-based, Co-based, Ni-based, Fe—Ni-based, Fe—Co-based, Fe—Al-based, Fe—Si-based, Fe—Si—Al-based, or Fe—Ni—Si—Al-based one; or an amorphous metallic magnetic material, such as Fe—Si—B-based, Fe—Si—B—Cr-based, Co—Si—B-based, Co—Zr-based, Co—Nb-based, or Co—Ta-based one. In addition to the magnetic particles described above, the magnetic resin layers 4*a* and 4*b* may each contain a filler for improving heat conductivity, particle packing characteristics, and the like.

Powder including spherical, flattened, or crushed particles, having a particle size (D50) in a range from several micrometers to 100 μm is used as the magnetic particles used for the magnetic resin layer 4*a*. Not only a single magnetic powder, but also a mixture of powders having different particle sizes, materials, and/or shapes may be used. If metallic magnetic particles, among others, of the magnetic particles described above are used, the complex permeability thereof has a frequency characteristic. Since this causes a loss due to skin effect at high operating frequencies, the particle size and the shape are selected depending on the band of the frequency used. The inductance value of the coil module 11 is determined by the average of the real part of the permeability (hereinafter referred to simply as average permeability) of the magnetic resin layers 4*a* and 4*b*, and this average permeability can be controlled by the mixture ratio between the magnetic particles and the resin. The relationship between the average permeability of the magnetic resin layers 4*a* and 4*b* and the permeability of the blended magnetic particles generally follows the logarithmic blending rule with respect to the amount blended, and therefore the fill ratio by volume of the magnetic particles is preferably greater than or equal to 40 vol %, at which inter-particle interaction begins to increase. Note that heat conduction characteristics of the magnetic resin layers 4*a* and 4*b* also increase with an increase in the fill ratio of the magnetic particles.

The magnetic particles used for the magnetic resin layer 4*b* preferably each have a spherical, elongated (cigar-shaped), or flattened (disk-shaped) spheroidal shape with a particle size (D50) in a range from several micrometers to 200 μm, and for these magnetic particles, powder of a spheroidal shape having a dimension ratio (major axis/minor axis) less than or equal to 6 is preferably used. Also with respect to the magnetic particles used for the magnetic resin layer 4*b*, not only a single powder of magnetic particles, but also a mixture of powders having different particle sizes, materials, and/or dimension ratios may be used. Since the spiral coil 2 is buried in the magnetic resin layer 4*a*, the magnetic resin layer 4*a* has a low fill ratio of the magnetic particles to ensure flowability and deformability before being cured. In contract, since the magnetic resin layer 4*b* is designed such that none or only a portion of the spiral coil 2 sinks thereinto, and thus the above-mentioned flowability and deformability may be low. Accordingly, the fill ratio of the magnetic particles is greater than that of the magnetic resin layer 4*a* to improve the magnetic shielding properties. In particular, for the purpose of improving magnetic properties by increasing the fillability, it is preferable to use, as the magnetic resin layer 4*b*, a dust core produced by mixing metallic magnetic particles, resin, lubricant, and the like together, and performing compression molding. The particle shape of the magnetic resin layer 4*b* is a sphere or a spheroid having a low dimension ratio, which shape achieves a large demagnetization factor, making it less likely to be saturated by an external magnetic field. Since the magnetic resin layer 4*b* is formed of such particles having a large demagnetization factor in resin, magnetic properties can be provided which is only slightly affected by magnetic saturation even in an environment where a strong magnetic field is applied.

A resin or the like that is cured by heat, ultraviolet irradiation, or other method is used as the bonding agent for forming the magnetic resin layers 4*a* and 4*b*. A known material may be used as the bonding agent, including, for example, a resin such as epoxy resin, phenolic resin, melamine resin, urea resin, or unsaturated polyester; a rubber such as silicone rubber, urethane rubber, acrylic rubber, butyl rubber, or ethylene propylene rubber; or the like. However, of course, the bonding agent is not limited thereto. Note that the resin or rubber described above may be added with an appropriate amount of surface treating agent, such as a fire retardant, reaction control agent, cross-linking agent, or silane-coupling agent.

The conductor wire 1 that forms the spiral coil 2 is preferably a single wire that is formed of Cu, or of an alloy made primarily of Cu, having a diameter in a range from 0.20 mm to 0.45 mm if the charge power capacity is about 5 W, and when used at a frequency about 120 kHz. Alternatively, to reduce skin effect of the conductor wire 1, the conductor wire 1 may be parallel wires, or a stranded wire, formed of a plurality of thin wires thinner than the single wire described above, or may be of an alpha winding type having one or two layers using a low-thickness rectangular or flat wire. Still alternatively, a flexible printed circuit (FPC) coil may be used, which is produced by thinly patterning a conductor on one or both surfaces of a dielectric substrate for reducing the thickness of the coil portion.

<Method for Manufacturing Coil Module>

A method for manufacturing the coil module 11 will next be described. First, a sheet for the magnetic resin layer 4*b* is produced. A kneaded mixture of the magnetic particles and the resin or rubber as the bonding agent is applied on a release-treated sheet made of, for example, PET, and an uncured sheet having a predetermined thickness is obtained using the doctor blade method or the like. A sheet for the magnetic resin layer 4*a* produced in a similar manner is placed thereon, the spiral coil 2 is pressed into the sheet, and then the bonding agent is cured by heating or heating under pressure to complete the coil module 11. The magnetic resin layer 4*b* filled with a large number of the magnetic particles can enhance the magnetic shielding properties by being placed under the spiral coil 2, and therefore, the magnetic resin layer 4*b* may be heated or heated under pressure in advance after being formed into a sheet to reduce flowability so that the spiral coil 2 is less likely to sink thereinto. The process may be continued in such a manner that the sheet for the magnetic resin layer 4*a* is placed thereon, the spiral coil 2 is pressed into the sheet, and then the bonding agent is cured by heating or heating under pressure to complete the coil module 11. Since the coil module 11 completed has the spiral coil 2 in close contact with the magnetic resin layer 4*a* having heat conductivity, heat generated in the spiral coil 2 can be effectively dissipated.

Another possible manufacturing method is to use a mold. First, a mixture of the magnetic particles, the bonding agent, and the like, prepared in a predetermined blend ratio for forming the magnetic resin layer 4*b* is poured into a mold, and is then dried. Next, a mixture of the magnetic particles, the bonding agent, and the like, prepared in a predetermined blend ratio for forming the magnetic resin layer 4*a* is poured on the magnetic resin layer 4*b* in the mold, and is then dried. Thereafter, the spiral coil 2 is placed on a predetermined location, heating under pressure is then performed from above the spiral coil 2, and thus the coil module 20 can be completed. Also in this case, similarly to the above-mentioned method for manufacturing by stacking the sheets, the magnetic resin layer 4*b* may be heated or heated under pressure to form a layer having low flowability, after which the magnetic resin layer 4*a* may be formed.

The spiral coil 2 may be completely buried in the magnetic shielding layer 4 as shown in FIGS. 1A and 1B, or may be configured such that a portion of the conductor wire 1 and a portion of the lead-out portion 3*b* are exposed. The magnetic shielding layer 4 may fill a region on the lower-face side of the conductor 1 and an external portion of the spiral coil 2, or may fill a region on the lower-face side of the conductor 1 and a radially inner portion of the spiral coil 2.

These manufacturing methods eliminate the need to use adhesive for bonding together the coil and the magnetic shield as required in the conventional example when the spiral coil 2 and the magnetic shielding layer 4 are to be secured to each other, since the magnetic shielding layer 4 itself has an adhesion property. This eliminates the step for providing the adhesive layer, and in addition, corrects warpage of the spiral coil 2 by curing under pressure when the spiral coil 2 is buried in the magnetic shielding layer 4, thereby enabling a coil module 11 having reduced variation in thickness to be produced. Moreover, non-inclusion of an adhesive layer can reduce the thickness of the coil module 11 accordingly. Furthermore, due to a resin described above being mixed, the magnetic resin layers 4*a* and 4*b* have reduced risk of cracks, such as cracks that occur in ferrite and the like on external impact, and thus there is no need to attach a protection sheet on the surface. This eliminates the step for attaching a protection sheet, and thus can reduce an increase in the thickness of the coil module 11 with respect to the protection sheet.

<Characteristics of Coil Module of First Embodiment>

Figure 2A:
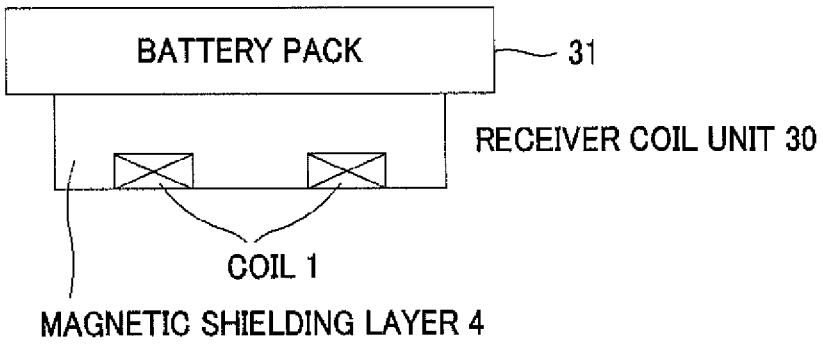
FIGS. 2A and 2B are each a simplified view showing measurement using a coil unit(s) used for measuring a coil inductance.
Figure 2B:
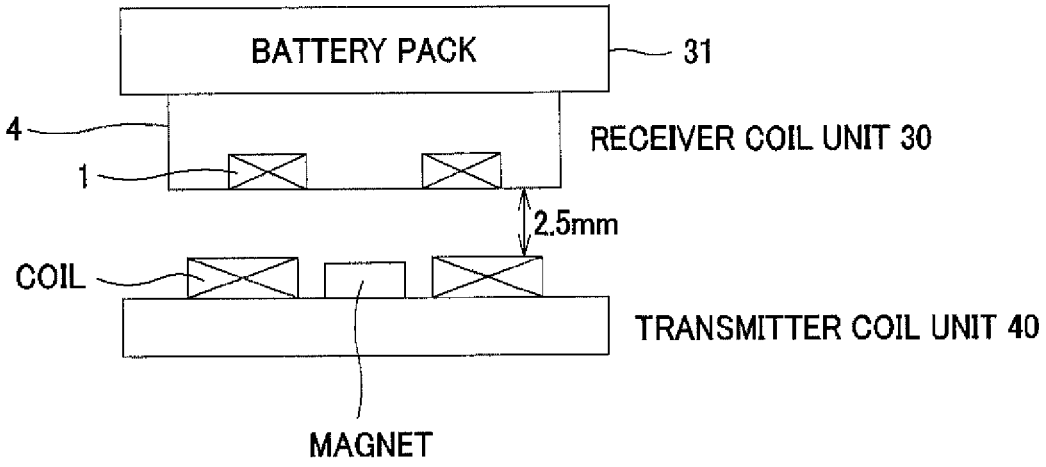

Characteristics of the coil module of the first embodiment were evaluated in terms of an effect of magnetic saturation on the coil inductance. A non-contact power transfer application has been assumed here for evaluation. FIGS. 2A and 2B are each a diagram showing a configuration of the evaluation coil during measurement. FIG. 2A shows a case without an external direct current magnetic field, where a battery pack 31 is attached to the magnetic shielding layer 4 side of a receiver coil unit 30. FIG. 2B shows a case with an external direct current magnetic field, where the receiver coil unit 30 shown in FIG. 2A faces a transmitter coil unit 40 having a magnet mounted thereon (design A1 shown in the WPC standard: System Description Wireless Power Transfer Volume 1: Low Power) with both centers of the coils aligned, interposing therebetween an acrylic board having a thickness of 2.5 mm. Inductance was measured by using Agilent 4294A Impedance Analyzer.

Figure 3A:
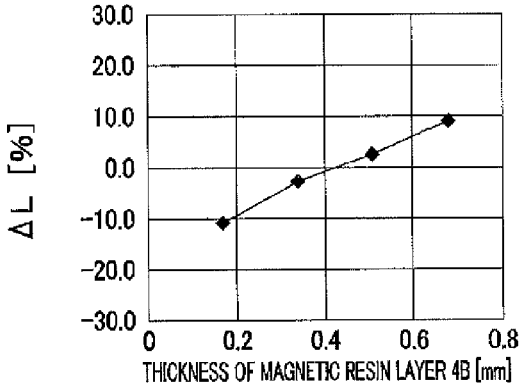
FIGS. 3A to 3D are each a graph showing a coil inductance characteristic with respect to magnetic saturation of a magnetic shielding layer.
Figure 3B:
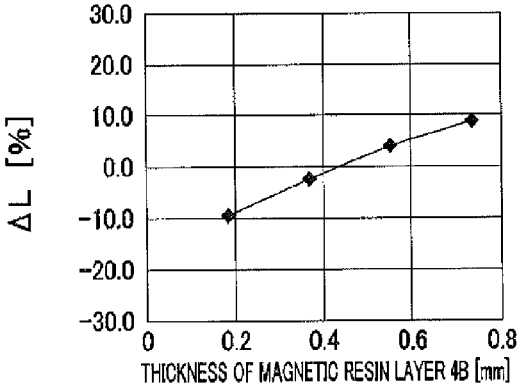
Figure 3C:
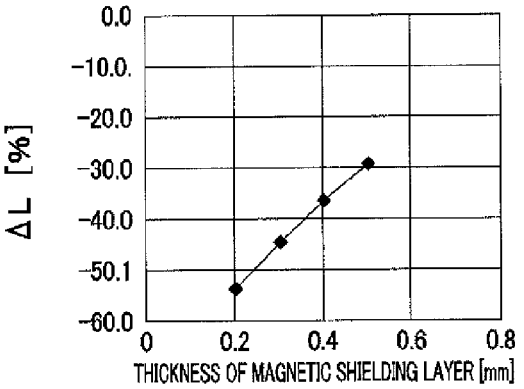
Figure 3D:
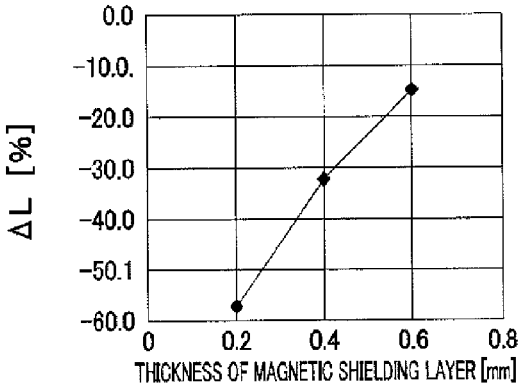

FIGS. 3A to 3D show measurement results of coil inductance of coil units in which various magnetic shielding layers 4 are attached to a rectangular coil (outer axes: 31×43 mm) of 14 T. Each graph shows a change in percentage of a measured value under the condition with an external direct current magnetic field as shown in FIG. 2B, with respect to a measured value under the condition without an external direct current magnetic field as shown in FIG. 2A. A negative value represents a decrease in the inductance. The graph shown in FIG. 3A shows a result of measurement carried out with a change in the thickness of the magnetic resin layer 4*b*, while using, as the magnetic shielding layer 4 of the coil module 11, a magnetic resin layer 4*a* having average permeability of about 10 with which an amorphous powder of spherical particles are blended, and a magnetic resin layer 4*b* having average permeability of about 20 with which an amorphous powder of spherical particles are blended. FIG. 3B shows a result of measurement carried out with a change in the thickness of the magnetic resin layer 4*b*, while using, as the magnetic shielding layer 4 of the coil module 11, a magnetic resin layer 4*a* having average permeability of about 10 with which an amorphous powder of spherical particles are blended, and a magnetic resin layer 4*b* having average permeability of about 16 with which a sendust powder of spherical particles are blended. FIG. 3C shows a result of measurement carried out with a change in the thickness of a magnetic sheet, while using, as the magnetic shielding layer 4, the magnetic sheet having average permeability of about 100 produced by mixing a sendust-based powder of flat particles having a dimension ratio of about 50 with a bonding agent. FIG. 3D shows a result of measurement carried out with a change in the thickness of bulk ferrite, while using, as the magnetic shielding layer 4, the MnZn-based bulk ferrite having permeability of about 1500.

When bulk ferrite was used for the magnetic shielding layer 4 as shown in FIG. 3D, the ferrite was magnetically saturated under the influence of the magnet mounted on the transmitter coil unit, and thus the inductance was significantly decreased. A thinner shield layer is more easily magnetically saturated, thereby causing this trend to be more distinct. Also, when a magnetic sheet was used as the magnetic shielding layer 4 as shown in FIG. 3C, a similar result to that of FIG. 3D was obtained. In contrast, in the examples in which a magnetic resin layer containing a powder of spherical particles is used as the magnetic shielding layer 4 as shown in FIGS. 3A and 3B, the decrease in the inductance is small. For the purpose of reference, a positive inductance value is accounted for by convergence of the magnetic flux to near the receiver coil unit due to a large magnetic shielding layer of the power transmitter coil unit. Thus, the configuration of the coil module of the first embodiment allows the coil inductance to change only slightly both for a magnet-mounted transmitter coil unit and in an environment where a strong direct current magnetic field is applied. Accordingly, the resonance frequency of a power receiving module changes only slightly, and thus stable power transmission can be provided.

Second Embodiment

Configuration of Coil Module

Figure 4A:
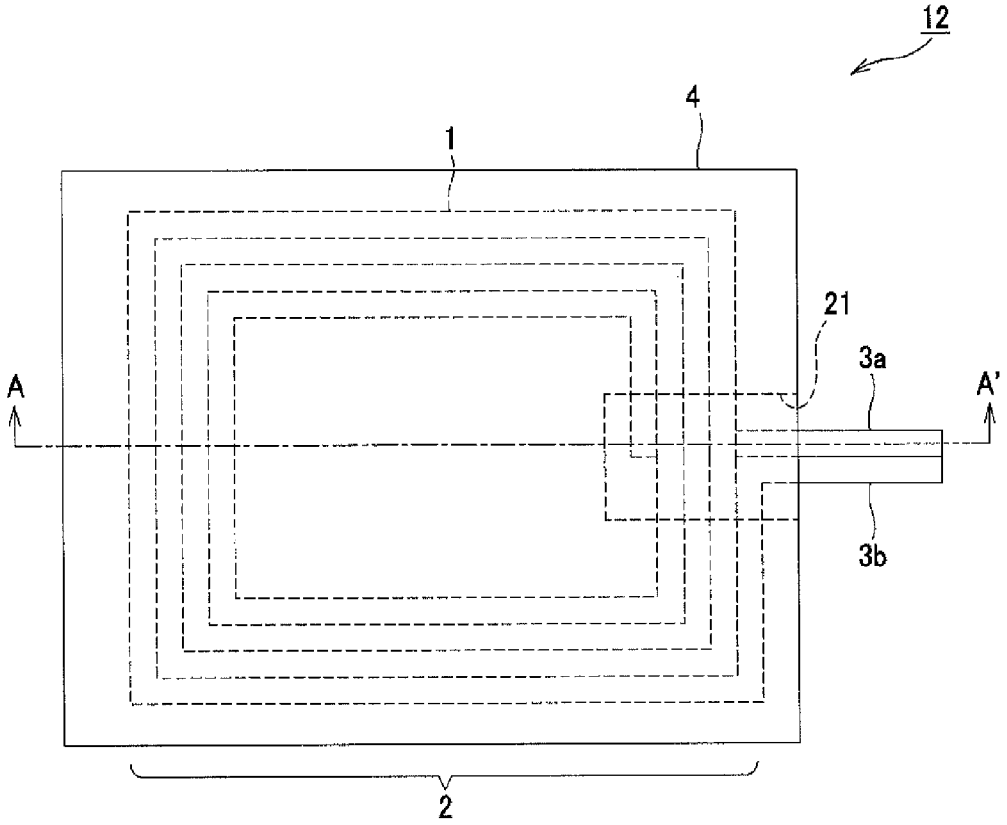
FIG. 4A is a top view showing a coil module according to a second embodiment, in which the present invention is implemented.
Figure 4B:
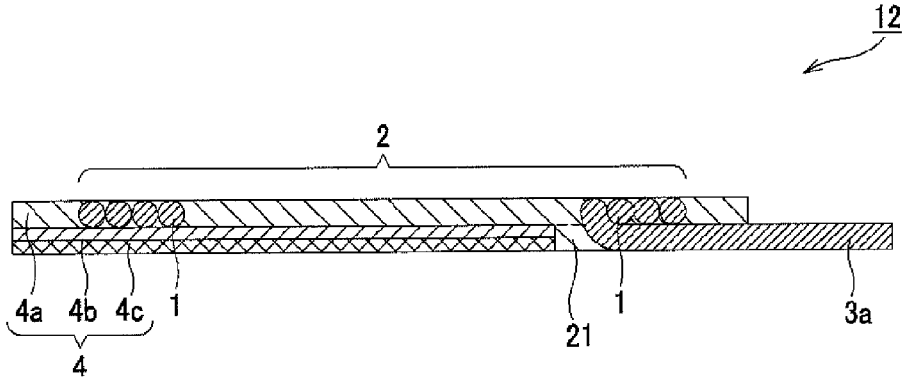
FIG. 4B is a cross-sectional view taken along line A-A' of FIG. 4A.

As shown in FIGS. 4A and 4B, a coil module 12 according to a second embodiment includes the spiral coil 2, formed by winding the conductor wire 1 in a spiral pattern, and, as the magnetic shielding layer 4 containing a magnetic material, the magnetic resin layers 4*a* and 4*b* each made of resin containing magnetic particles, and a magnetic layer 4*c*. The spiral coil 2 has the lead-out portions 3*a* and 3*b* at the ends of the conductor wire 1. By connecting a rectifier circuit or the like to the lead-out portions 3*a* and 3*b*, a secondary circuit of a non-contact charging circuit is formed. As shown in FIG. 4B, the lead-out portion 3*a* on the radially inner side of the spiral coil 2 passes under the conductor wire 1 being wound, and is drawn out to the radially outer side of the spiral coil 2 across the conductor wire 1. The magnetic resin layer 4*b* and the magnetic layer 4*c* are provided with a notch 21 formed of the magnetic particle-containing resin of the magnetic resin layer 4*a*, and the notch 21 receives therein the lead-out portion 3*a* on the radially inner side of the conductor wire 1 of the coil. Thus, the magnetic resin layers 4*a* and 4*b* and the magnetic layer 4*c* are preferably formed such that the entirety of the spiral coil 2 is buried therein. Since the total thickness of the magnetic resin layers 4*a* and 4*b* and the magnetic layer 4*c* can be twice or less the diameter of the conductor wire 1, the thickness of the coil module 12 can be twice the diameter of the conductor wire 1.

Each of the magnetic resin layers 4*a* and 4*b* contains magnetic particles of soft magnetic powder, and a resin as a bonding agent. The magnetic particles are made of an oxide magnetic material, such as ferrite; a crystalline or microcrystalline metallic magnetic material, such as Fe-based, Co-based, Ni-based, Fe—Ni-based, Fe—Co-based, Fe—Al-based, Fe—Si-based, Fe—Si—Al-based, or Fe—Ni—Si—Al-based one; or an amorphous metallic magnetic material, such as Fe—Si—B-based, Fe—Si—B—C-based, Co—Si—B-based, Co—Zr-based, Co—Nb-based, or Co—Ta-based one. In addition to the magnetic particles described above, the magnetic resin layers 4*a* and 4*b* may each contain a filler for improving heat conductivity, particle packing characteristics, and the like.

Powder including spherical, flattened, or crushed particles, having a particle size (D50) in a range from several micrometers to 100 μm is used as the magnetic particles used for the magnetic resin layer 4*a*. Not only a single magnetic powder, but also a mixture of powders having different particle sizes, materials, and/or shapes may be used. If metallic magnetic particles, among others, of the magnetic particles described above are used, the complex permeability thereof has a frequency characteristic. Since this causes a loss due to skin effect at high operating frequencies, the particle size and the shape are selected depending on the band of the frequency used. The inductance value of the coil module 11 is determined by the average of the real part of the permeability (hereinafter referred to simply as average permeability) of the magnetic resin layers 4*a* and 4*b*, and this average permeability can be controlled by the mixture ratio between the magnetic particles and the resin. The relationship between the average permeability of the magnetic resin layers 4*a* and 4*b* and the permeability of the blended magnetic particles generally follows the logarithmic blending rule with respect to the amount blended, and therefore the fill ratio by volume of the magnetic particles is preferably greater than or equal to 40 vol %, at which inter-particle interaction begins to increase. Note that heat conduction characteristics of the magnetic resin layers 4*a* and 4*b* also increase with an increase in the fill ratio of the magnetic particles.

The magnetic particles used for the magnetic resin layer 4*b* preferably each have a spherical, elongated (cigar-shaped), or flattened (disk-shaped) spheroidal shape with a particle size (D50) in a range from several micrometers to 200 μm, and for these magnetic particles, powder of a spheroidal shape having a dimension ratio (major axis/minor axis) less than or equal to 6 is preferably used. Also with respect to the magnetic particles used for the magnetic resin layer 4*b*, not only a single powder of magnetic particles, but also a mixture of powders having different particle sizes, materials, and/or dimension ratios may be used. Since the spiral coil 2 is buried in the magnetic resin layer 4*a*, the magnetic resin layer 4*a* has a low fill ratio of the magnetic particles to ensure flowability and deformability before being cured. In contract, since the magnetic resin layer 4*b* is designed such that none or only a portion of the spiral coil 2 sink thereinto, and thus the above-mentioned flowability and deformability may be low. Accordingly, the fill ratio of the magnetic particles is greater than that of the magnetic resin layer 4*a* to improve the magnetic shielding properties. The particle shape of the magnetic resin layer 4*b* is a sphere or a spheroid having a low dimension ratio, which shape achieves a large demagnetization factor, making it less likely to be saturated by an external magnetic field. Since the magnetic resin layer 4*b* is formed of such particles having a large demagnetization factor in resin, magnetic properties can be provided which is only slightly affected by magnetic saturation even in an environment where a strong magnetic field is applied.

As far as the magnetic layer 4*c* is concerned, a green compact may be used which is manufactured by compression molding after adding a small amount of binder to a metallic magnetic material having a high permeability, such as sendust, permalloy, or amorphous one, to MnZn-based ferrite, to NiZn-based ferrite, or to the magnetic particles used for the magnetic resin layers 4*a* and 4*b*. Alternatively, the magnetic layer 4*c* may be a magnetic resin layer in which magnetic particles are densely packed in resin or the like. The magnetic layer 4*c* is provided for further increasing the coil inductance, and is thus designed to have average permeability greater than that of the magnetic resin layers 4*a* and 4*b*. Any magnetic material may be employed for the magnetic layer 4*c* as long as the relationships described above can be provided regardless of the kind, the shape, the size, the structure, and the like.

The magnetic layer 4*c* is provided for improving magnetic shielding performance, and effectively improving the coil inductance. Therefore, although the magnetic layer 4*c* is shown as provided under the magnetic resin layer 4*b* in the configuration shown in FIGS. 4A and 4B, the magnetic layer 4*c* may be provided between the magnetic resin layer 4*a* and the magnetic resin layer 4*b*, and may be provided such that all or a portion thereof is buried in the magnetic resin layer 4*a* and/or the magnetic resin layer 4*b*.

A resin or the like that is cured by heat, ultraviolet irradiation, or other method is used as the bonding agent for forming the magnetic resin layers 4*a* and 4*b*. A known material may be used as the bonding agent, including, for example, a resin such as epoxy resin, phenolic resin, melamine resin, urea resin, or unsaturated polyester; a rubber such as silicone rubber, urethane rubber, acrylic rubber, butyl rubber, or ethylene propylene rubber; or the like. However, of course, the bonding agent is not limited thereto. Note that the resin or rubber described above may be added with an appropriate amount of surface treating agent, such as a fire retardant, reaction control agent, cross-linking agent, or silane-coupling agent.

The conductor wire 1 that forms the spiral coil 2 is preferably a single wire that is formed of Cu, or of an alloy made primarily of Cu, having a diameter in a range from 0.20 mm to 0.45 mm if the charge power capacity is about 5 W, and when used at a frequency about 120 kHz. Alternatively, to reduce skin effect of the conductor wire 1, the conductor wire 1 may be parallel wires, or a stranded wire, formed of a plurality of thin wires thinner than the single wire described above, or may be of an alpha winding type having one or two layers using a low-thickness rectangular or flat wire. Still alternatively, a flexible printed circuit (FPC) coil may be used, which is produced by thinly patterning a conductor on one or both surfaces of a dielectric substrate for reducing the thickness of the coil portion.

<Characteristics of Coil Module of Second Embodiment>

Coil inductance was measured for investigating effectiveness of the coil module 12 according to the second embodiment. Similarly to the characterization of the coil module 11 of the first embodiment, measurements were made for a case without an external direct current magnetic field and for a case with an external direct current magnetic field shown respectively in FIGS. 2A and 2B. Inductance was measured by using Agilent 4294A Impedance Analyzer.

Figure 5:
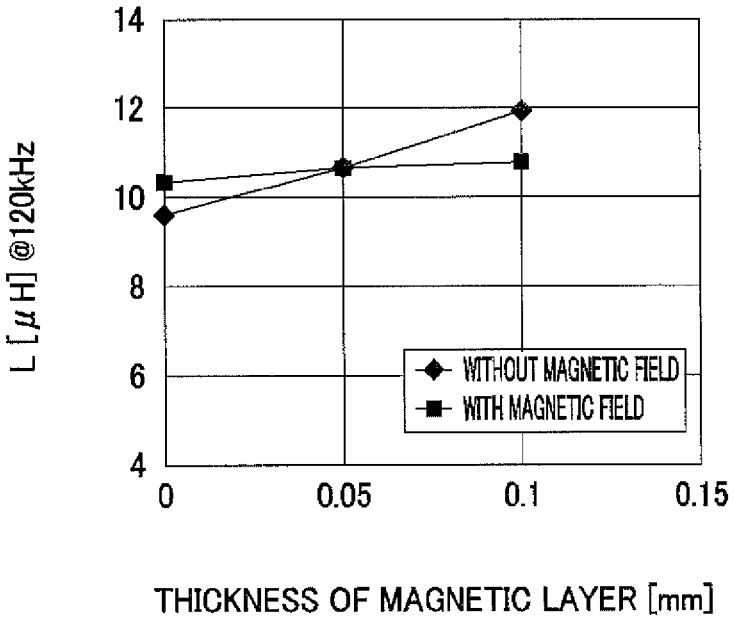
FIG. 5 is a graph showing coil inductance characteristics of a coil module of the second embodiment.

FIG. 5 is a graph showing measurement results of coil inductance when a 50 μm or 100 μm thick magnetic layer 4*c* is attached on the magnetic resin layer 4*b* side of the coil module 12 that uses a rectangular coil (outer shape: 28×49 mm) of 15 T. The magnetic shielding layer 4 of the evaluation coil unit includes a magnetic resin layer 4*a* having average permeability of about 10 with which an amorphous powder of spherical particles are blended, a magnetic resin layer 4*b* (0.4 mm thick) having average permeability of about 20 with which an amorphous powder of spherical particles are blended, and also the magnetic layer 4*c*. A magnetic sheet, having permeability of about 100, produced by mixing a sendust-based powder of flat particles having a dimension ratio of about 50 with a bonding agent, is used as the magnetic layer 4*c*. As can be seen from FIG. 5, adding the thin magnetic layer 4*c* can significantly increase the coil inductance. However, as shown in FIG. 3C where magnetic saturation caused by the magnet is high, the magnetic layer 4*c* has only a small effect on increasing inductance when a strong magnetic field is being applied. When comparison is made for the same thickness, the magnetic layer 4*c* has a greater effect on increasing inductance than the magnetic resin layer 4*b*, and conversely, the magnetic resin layer 4*b* has a greater effect on increasing inductance when a strong magnetic field is being applied. Accordingly, selection of the ratio between the two layers described above can adjust the coil inductance, which has significant effect on magnetic shielding properties and on the resonant condition of the circuit, and the magnetic saturation characteristic of the coil inductance, for enabling desired performance.

[Variation]

<Configuration of Coil Module>

Figure 6A:
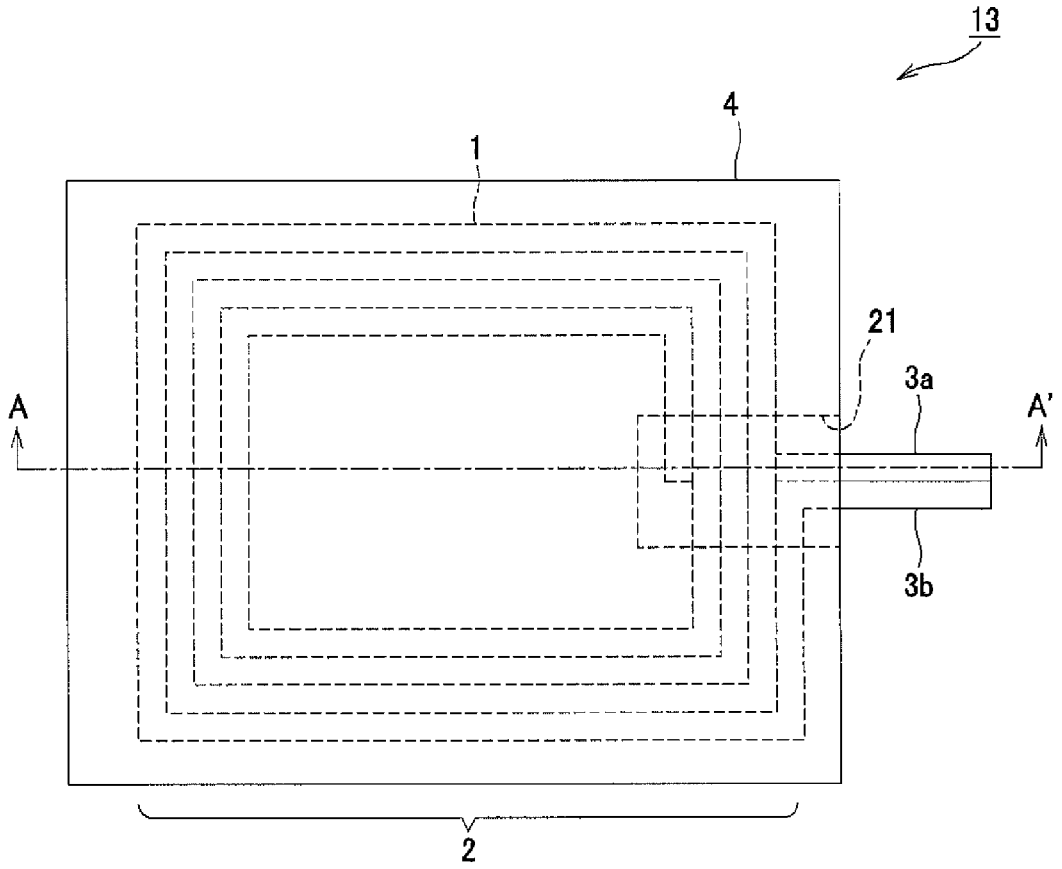
FIG. 6A is a top view showing a coil module of a variation according to the second embodiment, in which the present invention is implemented.
Figure 6B:
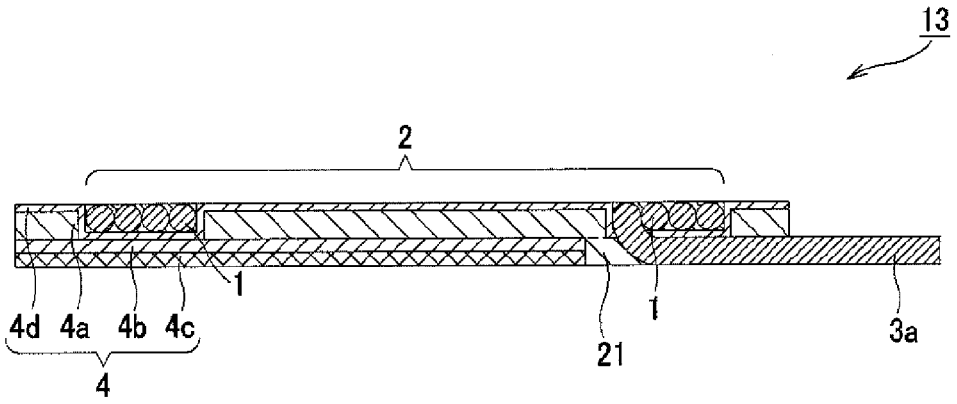
FIG. 6B is a cross-sectional view taken along line A-A' of FIG. 6A.
Figure 7A:
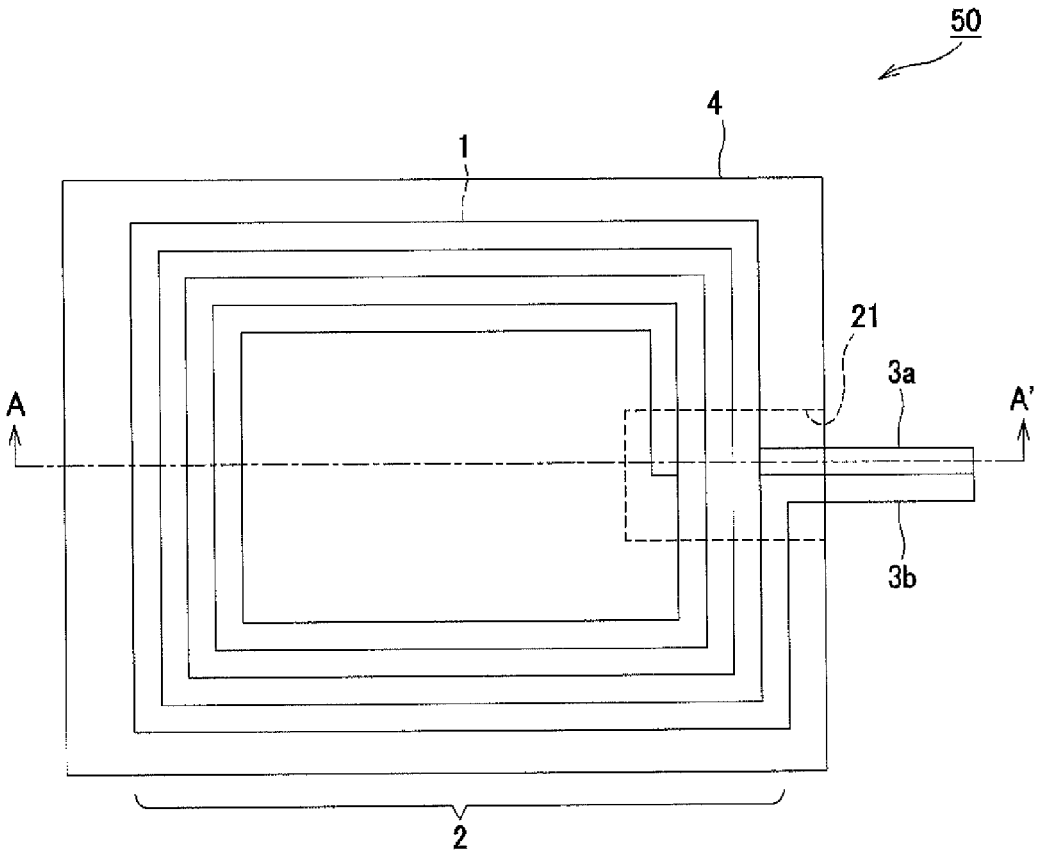
FIG. 7A is a top view of a conventional coil module described in Patent Document 1.
Figure 7B:
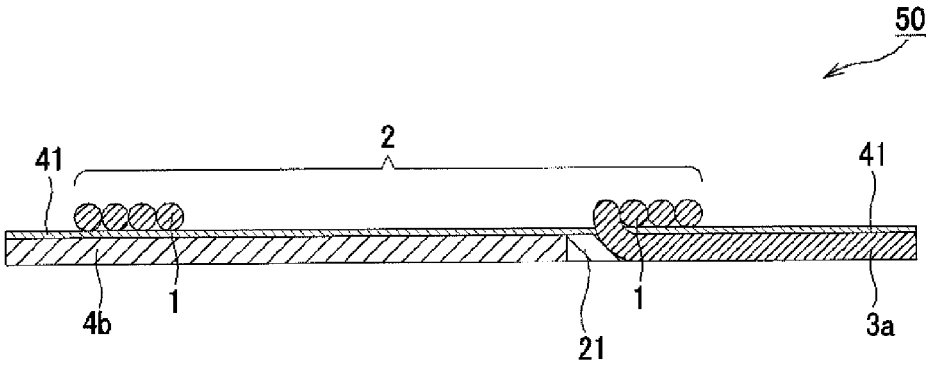
FIG. 7B is a cross-sectional view taken along line A-A' of FIG. 7A.

As shown in FIGS. 6A and 6B, a coil module 13 shown as a variation includes, as the magnetic shielding layer 4, the magnetic resin layers 4*a* and 4*b* each made of resin containing magnetic particles, the magnetic layer 4*c*, and a magnetic resin layer 4*d*. Except for this, the coil module 13 is configured similarly to the coil module 12 according to the second embodiment. The spiral coil 2 has the lead-out portions 3*a* and 3*b* at the ends of the conductor wire 1. By connecting a rectifier circuit or the like to the lead-out portions 3*a* and 3*b*, a secondary circuit of a non-contact charging circuit is formed. As shown in FIG. 6B, the lead-out portion 3*a* on the radially inner side of the spiral coil 2 passes under the conductor wire 1 being wound, and is drawn out to the radially outer side of the spiral coil 2 across the conductor wire 1. The magnetic resin layer 4*b* and the magnetic layer 4*c* are provided with a notch 21 formed of the magnetic particle-containing resin of the magnetic resin layer 4*a*, and the notch 21 receives therein the lead-out portion 3*a* on the radially inner side of the conductor wire 1 of the coil. Thus, the magnetic resin layers 4*a*, 4*b*, and 4*d*, and the magnetic layer 4*c* are preferably formed such that the entirety of the spiral coil 2 is buried therein. Since the total thickness of the magnetic resin layers 4*a*, 4*b*, and 4*d*, and the magnetic layer 4*c* can be twice or less the diameter of the conductor wire 1, the thickness of the coil module 13 can be twice the diameter of the conductor wire 1.

The magnetic resin layer 4*d* is disposed between the spiral coil 2 and the magnetic resin layer 4*a*. Due to flowability and deformability of the magnetic resin layer 4*a*, applying pressure to the spiral coil 2 for burying may cause the magnetic resin layer 4*a* to penetrate into spaces in the conductor wire 1 to increase the spacing between windings of the spiral coil 2 if the bonding force between windings of the conductor wire of the spiral coil 2 is low. The magnetic resin layer 4*d* is provided to prevent this penetration of the magnetic resin layer 4*a* into the spiral coil 2, and to improve magnetic properties of the coil module 13.

The magnetic resin layer 4*d* contains magnetic particles of soft magnetic powder, and a resin as a bonding agent. The magnetic particles are made of an oxide magnetic material, such as ferrite; a crystalline or microcrystalline metallic magnetic material, such as Fe-based, Co-based, Ni-based, Fe—Ni-based, Fe—Co-based, Fe—Al-based, Fe—Si-based, Fe—Si—Al-based, or Fe—Ni—Si—Al-based one; or an amorphous metallic magnetic material, such as Fe—Si—B-based, Fe—Si—B—C-based, Co—Si—B-based, Co—Zr-based, Co—Nb-based, or Co—Ta-based one. In addition to the magnetic particles described above, the magnetic resin layer 4*d* may contain a filler for improving heat conductivity, particle packing characteristics, and the like.

Since the purpose of the magnetic resin layer 4*d* is to improve magnetic performance of the coil module 13, and to prevent the magnetic resin layer 4*a* having high flowability and deformability from penetrating into spaces between windings of the conductor wire of the spiral coil 2, the magnetic material and the bonding agent are selected such that flowability and deformability thereof before being cured are lower than those of the magnetic resin layer 4*a*. A filler of fine stick-shaped or plate-shaped particles may be mixed for further improving the strength of the layer.

As described above, the coil modules of the embodiments only include a coil and magnetic members, and therefore can achieve a reduction in size and thickness of the coil modules. In addition, since a major portion of the coil is in contact with the magnetic resin layer having heat conductivity, heat generated in the coil can be effectively dissipated. Moreover, since the magnetic resin layers resistant to magnetic saturation are provided, the coil inductance changes only slightly even in an environment where a strong magnetic field is applied, and thus power can stably be transferred. Furthermore, control of the thicknesses of the magnetic resin layers and of the magnetic layer can adjust the balance between the magnitude of coil inductance and a rate of change in the coil inductance in an environment with a strong magnetic field.

Note that, although the coil modules described above have been described as each having a single spiral coil 2, such coil modules are not limited thereto, but may be configured such that, for example, another antenna module is provided on the radially inner side, or on the external side, of the coil module. In addition, the coil modules described above are applicable to an antenna unit for non-contact power transmission, and can be incorporated in various electronic devices.

REFERENCE SYMBOLS

1 Conductor wire
2 Spiral coil
3*a*, 3*b* Lead-out portion
4 Magnetic shielding layer
4*a*, 4*b*, 4*d* Magnetic resin layer
4*c* Magnetic layer
11, 12, 13, 50 Coil module
21 Notch
30 Receiver coil unit
31 Battery pack
40 Transmitter coil unit
41 Adhesive layer

The invention claimed is:

1. A coil module comprising:

a magnetic shielding layer in a sheet shape containing a magnetic material; and a spiral coil, the spiral coil having a conductor that is wound into a coil shape having a radially inner side and a radially outer side, wherein the magnetic shielding layer includes a plurality of magnetic resin layers each containing magnetic particles, and at least a portion of the spiral coil is buried in a portion of the magnetic resin layers, a remaining portion of the spiral coil is released from the magnetic resin layers, and the remaining portion extends from the radially inner side across the spiral coil to the radially outer side and is released from the magnetic resin layers on the radially outer side.

2. A coil module comprising:

a magnetic shielding layer in a sheet shape containing a magnetic material; and a spiral coil, the spiral coil having a conductor that is wound into a coil shape having a radially inner side and a radially outer side, wherein the magnetic shielding layer includes a plurality of magnetic resin layers each containing magnetic particles, and a magnetic layer, and at least a portion of the spiral coil is buried in a portion of the magnetic resin layers, a remaining portion of the spiral coil is released from the magnetic resin layers, layers, and the remaining portion extends from the radially inner side across the spiral coil to the radially outer side and is released from the magnetic resin layers on the radially outer side.

3. The coil module according to claim 1, wherein, among the plurality of magnetic resin layers, a magnetic resin layer in contact with the spiral coil has a higher strength before being cured than a strength of other magnetic resin layer.

4. The coil module according to claim 1, wherein at least one of the plurality of magnetic resin layers is a dust core produced by mixing a metallic magnetic powder, a resin, a lubricant, and the like together, and performing compression molding.

5. The coil module according to claim 1, wherein the spiral coil is buried so that a radially inner portion of the spiral coil is filled with a portion of the magnetic resin layers.

6. The coil module according to claim 1, wherein at least one magnetic resin layer of the plurality of magnetic resin layers that form the magnetic shielding layer contains a magnetic material of particles of a spherical shape or of a spheroidal shape having a dimension ratio (major axis/minor axis) less than or equal to 6.

7. The coil module according to claim 1, wherein the magnetic shielding layer receives a terminal that protrudes in a thickness direction of the coil module of the spiral coil.

8. The coil module according to claim 1, wherein the spiral coil is a flexible printed circuit (FPC) coil produced by patterning a conductive layer on one or both surfaces of a dielectric substrate.

9. The coil module according to claim 1, wherein another antenna module is provided on a radially inner side, or on an external side, of the coil module.

10. An antenna unit for non-contact power transmission comprising the coil module according to claim 1.

11. An electronic device comprising the coil module according to claim 1.

* * * * *